US005979391A

United States Patent [19]

Ulrich et al.

[11] Patent Number: 5,979,391

[45] Date of Patent: Nov. 9, 1999

[54] CAST LIGHT METAL PISTON FOR A TWO-STROKE ENGINE

[75] Inventors: Reiner Ulrich, Weissach; Joachim Schmidt, Stuttgart; Udo Buschkamp, Hausen, all of Germany

[73] Assignee: Mahle GmbH, Stuttgart, Germany

[21] Appl. No.: 09/051,049

[22] PCT Filed: Oct. 10, 1996

[86] PCT No.: PCT/DE96/01937

§ 371 Date: Mar. 31, 1998

§ 102(e) Date: Mar. 31, 1998

[87] PCT Pub. No.: WO97/14880

PCT Pub. Date: Apr. 24, 1997

[30] Foreign Application Priority Data

Oct. 16, 1995 [DE] Germany ..... 195 38 407

[51] Int. Cl.[6] ..... F02F 1/00

[52] U.S. Cl. ..... 123/193.6; 92/208

[58] Field of Search ..... 123/193.6; 92/208

[56] References Cited

U.S. PATENT DOCUMENTS

| | | | |
|---|---|---|---|
| 4,161,163 | 7/1979 | Boyesen . | |
| 4,195,600 | 4/1980 | Shingai . | |
| 4,704,950 | 11/1987 | Ripberger et al. | 92/208 |
| 5,063,893 | 11/1991 | Iwaya | 123/193.6 |
| 5,562,074 | 10/1996 | Koch | 123/193.6 |
| 5,601,010 | 2/1997 | Sawada et al. | 123/193.6 |
| 5,630,391 | 5/1997 | Anderson et al. | 123/193.6 |
| 5,701,533 | 12/1997 | Junge | 123/193.6 |
| 5,778,533 | 7/1998 | Kemnitz | 123/193.6 |

FOREIGN PATENT DOCUMENTS

| | | |
|---|---|---|
| 312162 | 10/1988 | European Pat. Off. . |
| 1081882 | 12/1954 | France . |
| 1301658 | 8/1969 | Germany . |
| 1476085 | 12/1971 | Germany . |

OTHER PUBLICATIONS

Patent Abstracts of Japan, vol. 006, No. 181 (M–156), Sep. 17, 1982 and JP 57 088253 A (Yamaha Motor Co. Ltd). Jun. 2, 1982.

*Primary Examiner*—John Kwon
*Attorney, Agent, or Firm*—Collard & Roe, P.C.

[57] ABSTRACT

A cast light metal piston of box-type construction for a two-stroke engine, comprising a piston blank having a gudgeon pin boss molded on a bottom section of the piston blank and a piston shaft having an open end and being connected to the gudgeon pin boss via approximately straight wall sections. There is only one lug disposed on only one side of the piston shaft. The wall section connecting the piston shaft with the gudgeon pin boss near the lug has a window-like recess. The wall section connecting the piston shaft with the gudgeon pin boss remote from the lug is closed and is raised upwardly with respect to the length of the shaft beginning from the open end of the shaft.

1 Claim, 1 Drawing Sheet

FIG. 1
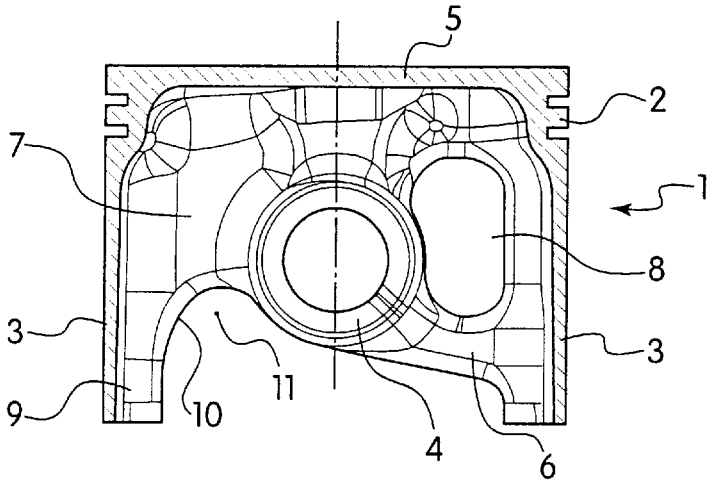
FIG. 2
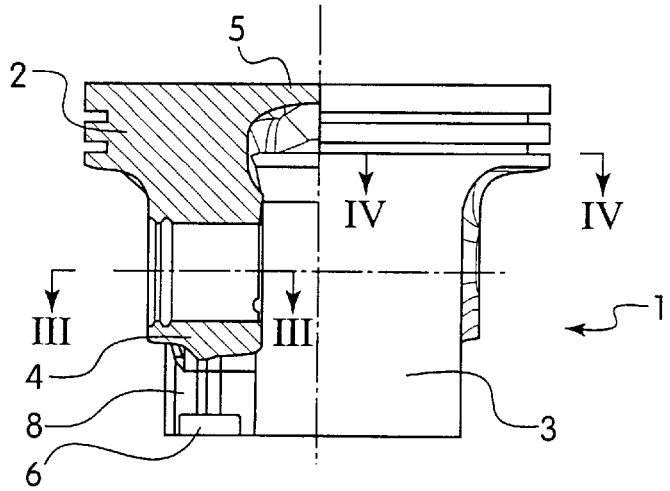
FIG. 3
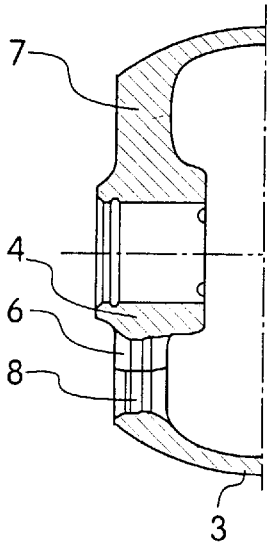
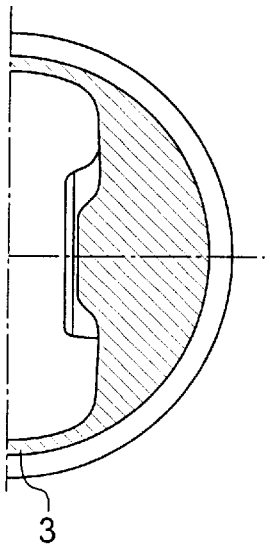
FIG. 4

CAST LIGHT METAL PISTON FOR A TWO-STROKE ENGINE

The invention relates to a cast light metal piston for a two-stroke engine as defined in the introductory part of the patent claim.

Such a light metal piston is known in practical life with a box-type construction, whereby provision is made for a window-like recess in each of the wall sections connecting the piston shaft with the gudgeon-pin boss, so that cooling of the piston is achieved as the gas mixture flows through the four windows from the inside outwardly.

A drawback of such a design is the high manufacturing expenditure when the piston is cast in order to avoid in particular cold shuts in the area of the window-like recesses.

The problem of the present invention is to find in a constructionally uncomplicated way a piston that can be produced in a simple manner in terms of casting technique and which fully satisfies the requirements specified for a two-stroke engine with respect to cooling, low weight and mixture transfer.

Said problem is solved by a cast light metal piston with the features according to the characterizing part of the patent claim.

The invention is particularly based on the finding that with one lug on one side, which is favorable in terms of both production expenditure and cost, it is possible without problems in terms of casting technique to produce a window-like recess in each wall section connecting the piston shaft with the guegeon-pin boss on the lug side, on the one hand, while still obtaining adequate cooling of the piston, on the other. Furthermore, a superior flow of heat from the bottom of the piston to the piston shaft is obtained through the other, closed wall section, on the one hand, and no axial displacement of the piston pin is requird on one gudgeon-pin boss due to the difference in mass between the two wall sections, on the other hand, which further reduced the production expenditure. In addition, a higher gas through-put is attainable due to the fact that the closed wall section is raised upwardly at the bottom.

The invention is explained in greater detail with the help of a preferred exemplified embodiment shown in the drawing, in which:

FIG. 1 is a sectional view of a piston as defined by the invention.

FIG. 2 is a partly sectional side view.

FIG. 3 shows a section III—III according to FIG. 2; and

FIG. 4 shows a section IV—IV according to FIG. 2.

A cast light metal piston 1 of the box-type design for a two-stroke engine, for example a motor for driving a chain saw, consists in one piece of a piston head 2 and a piston shaft 3, whereby gudgeon-pin bosses 4 are formed by molding on piston bottom 5, forming one piece with the latter, and connected with piston shaft 3 via straight wall sections 6, 7.

Provision is made for a window-like recess 8 in each wall section 6 on the lug side of piston 1, such recess being manufacturable without problems in the present case in terms of casting technique and particularly serving for cooling, weight reduction and through-flow of the mixture.

Wall section 7, which is disposed removed from the lug side in each case, is designed closed down to piston bottom 5 and raised upwardly (10) within its lower zone disposed on open shaft end 9, so that a recess 11 is obtained here, such recess cooperating with mating openings in the cylinder (not shown in the drawing) in order to obtain controlled mixture transfer. Due to the difference in design between the two wall sections 6 and 7 on one gudgeon-pin boss 4, different masses are obtained with respect to the plane extending through the center of the gudgeon-pin boss along the longitudinal axis of the piston, so that axial displacement of the piston pin axis otherwise required for minimizing the noise can be dispensed with.

Such a design creates in a constructionally simple way a cast light metal piston for a two-stroke engine which, by virtue of the combination of its features represents an optimal compromise with respect to casting properties, cooling, and noise reduction and mixture transfer.

We claim:

1. A cast light metal piston of box-type construction for a two-stroke engine, comprising:

a piston blank having a gudgeon pin boss molded on a bottom section of said piston blank a piston shaft having an open end and being connected to said gudgeon pin boss via approximately straight wall sections, wherein there is only one lug disposed on only one side of the piston shaft;

wherein the wall section connecting the piston shaft with the gudgeon pin boss near the lug has a window-like recess, and wherein the wall section connecting the piston shaft with the gudgeon pin boss remote from the lug is closed, said wall section remote from the lug being raised upwardly with respect to the length of the shaft beginning from the open end of the shaft.

* * * * *